US009230525B2

(12) United States Patent
Hunter et al.

(10) Patent No.: US 9,230,525 B2
(45) Date of Patent: Jan. 5, 2016

(54) STRING CHANGING DEVICE FOR BIGSBY TAILPIECES

(71) Applicants: Steve Hunter, Phoenix, AZ (US); Karen Hunter, Phoenix, AZ (US)

(72) Inventors: Steve Hunter, Phoenix, AZ (US); Karen Hunter, Phoenix, AZ (US)

( * ) Notice: Subject to any disclaimer, the term of this patent is extended or adjusted under 35 U.S.C. 154(b) by 32 days.

(21) Appl. No.: 14/175,609

(22) Filed: Feb. 7, 2014

(65) Prior Publication Data

US 2014/0230628 A1 Aug. 21, 2014

Related U.S. Application Data

(60) Provisional application No. 61/765,949, filed on Feb. 18, 2013, provisional application No. 61/858,046, filed on Jul. 24, 2013.

(51) Int. Cl.

| | |
|---|---|
| ***G10D 3/10*** | (2006.01) |
| ***G10G 7/00*** | (2006.01) |
| ***G10D 3/00*** | (2006.01) |

(52) U.S. Cl.
CPC . *G10G 7/00* (2013.01); *G10D 3/006* (2013.01)

(58) Field of Classification Search
CPC ..... G10D 3/10; G10D 3/14; G10D 3/143
USPC ..... 84/297 R, 297 S, 299–302
See application file for complete search history.

(56) References Cited

U.S. PATENT DOCUMENTS

2003/0200857 A1* 10/2003 Ball ..... 84/453

* cited by examiner

*Primary Examiner* — Kimberly Lockett
(74) *Attorney, Agent, or Firm* — Venjuris, P.C.

(57) ABSTRACT

A method and devices for changing and dampening guitar strings are disclosed. The string changing device comprises a flexible urethane foam having trapezoidal sides so that the front face of the device can be inserted into the space between the Bigsby tailpiece and a front face of a guitar to temporarily hold at least one eyelet of a guitar string onto a pin of the Bigsby tailpiece while a guitar string installer is installing a string on a headstock tuning peg.

3 Claims, 11 Drawing Sheets

Flexible urethane foam (Polyether-based urethane polymer)
Density 0.9 - 4.0 lbs. per cu. ft.

Showing wedge in position under bar, holding eyelet of new string on pin until the string is wound on the tuning peg at the other end and wound tight enough to stay put.

Showing bar with one pin exposed

Showing the Bigsby device with the pins on the bar

Showing headstock and tuning pegs

Flexible urethane foam (Polyether-based urethane polymer)
Density 0.9 - 4.0 lbs. per cu. ft.

Showing wedge being placed under bar

Showing wedge in position under bar, holding eyelet of new string on pin until the string is wound on the tuning peg at the other end and wound taught enough to stay put.

Using wedge as a Damper

STRING CHANGING DEVICE FOR BIGSBY TAILPIECES

CROSS-REFERENCE TO RELATED APPLICATIONS

The present application claims priority from prior provisional applications: Ser. No. 61/765,949, filed Feb. 28, 2013, entitled "String Changing Device For Bigsby Tailpieces," and Ser. No. 61/858,046, filed Jul. 24, 2013, entitled "String Changing Device For Bigsby Tailpieces," the contents of both of which are incorporated herein by this reference and are not admitted to be prior art with respect to the present invention by the mention in this cross-reference section.

FIELD OF THE INVENTION

The present invention relates to a device for changing and dampening guitar strings, and more specifically for changing guitar strings on guitar with a Bigsby vibrato tailpiece.

DESCRIPTION OF RELEVANT ART

Some guitars have what is known as a Bigsby vibrato tailpiece attachment (the "Bigsby tailpiece"). As shown in FIG. 1, the Bigsby tailpiece is a type of vibrato device for electric guitar designed by Paul A. Bigsby. The device allows musicians to bend the pitch of notes or entire chords with their pick hand for various effects.

It is notoriously difficult to change strings on any guitar with a Bigsby tailpiece because of the small pins that jut out from the metal bar on the device that hangs across the width of the neck on the body end including the Bridge. See FIGS. 2-3. Most metal guitar strings have a small eyelet at one end, this eyelet needs to be attached to the body end of the guitar, and then the string is laid loosely up the neck where the other end is wound into the tuning peg of the headstock to get the right tension for tuning. See FIG. 4.

On a Bigsby tailpiece, the eyelet of the new string needs to be slid onto one of the pins on the metal bar; the string is then pulled under then back over the bar in order to lay it up the neck so it can be wound onto the tuning peg. See FIG. 2. At this point, the string installer's hands are up at the headstock/tuning peg end winding the string into the tuning peg (see FIG. 4), and the eyelet at the other end invariably springs off the pin (see FIG. 2).

For many years guitar players have found the re-stringing of a Bigsby tailpiece difficult. People have come up with many home remedies to combat the problem, from a piece of rag, to a wife's make up sponge, to a pencil. Other people opt to clamp a capo high up on the neck, thus holding the string taught until it is threaded into the tuning peg. None of these devices work adequately well.

Further, ringing in the neck of the guitar has been a problem for some players when the Bigsby tailpiece is installed.

SUMMARY OF THE INVENTION

The structure, overall operation and technical characteristics of the present invention will become apparent with the detailed description of preferred embodiments and the illustration of the related drawings as follows.

Generally, the present invention is incorporated in a flexible urethane foam having trapezoidal sides so that the front face of the device can be inserted into the space between the Bigsby tailpiece and a front face of a guitar to temporarily hold at least one eyelet of a guitar string onto a pin of the Bigsby tailpiece while a guitar string installer is installing a string on a headstock tuning peg.

It is an object of this invention to keep the eyelet of a guitar string in place over the pin so that one can concentrate on the headstock end until the other end of the string is taut enough for the eyelet to not spring off the pin.

It is another object of this invention to create a foam wedge shape that can be pushed under a Bigsby bar from the back via the narrow end of the wedge with the angle of the wedge gradually getting deep enough to be the determining factor on how far under it would go.

It is another object of this invention to create a foam wedge shape that can be turned over and inserted under the strings between the Bigsby bar and the bridge to act as a damper on the strings to lessen or prevent "ringing" of the strings in the guitar.

BRIEF DESCRIPTION OF THE DRAWINGS OR PICTURES

Figure 6:
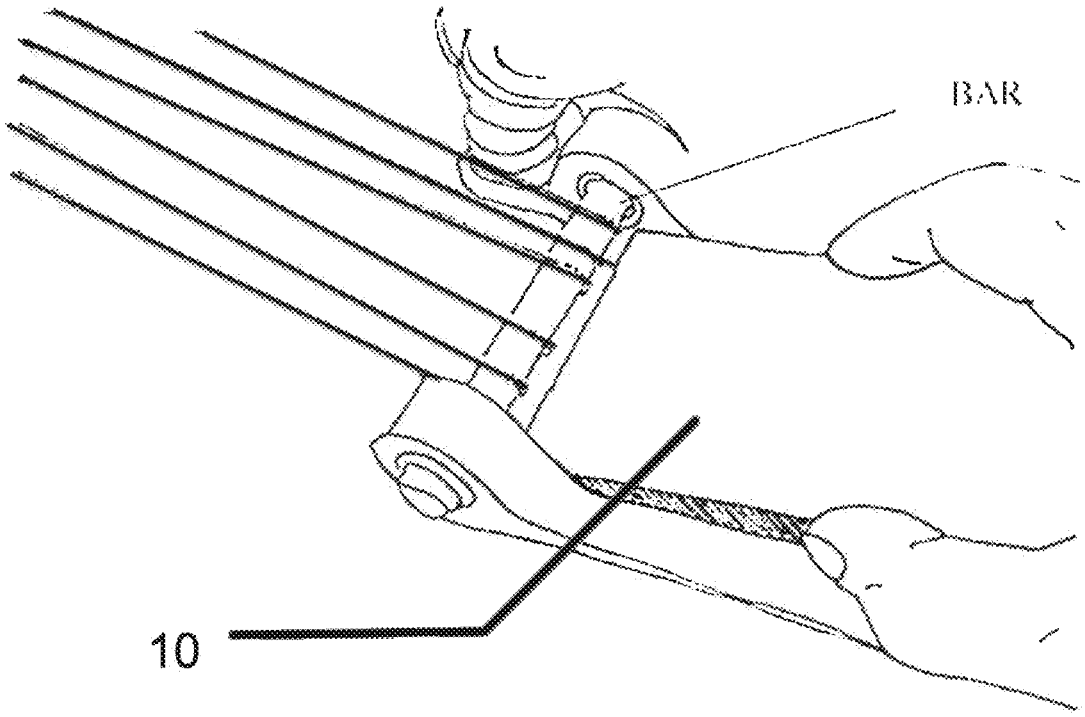
Figure 7:
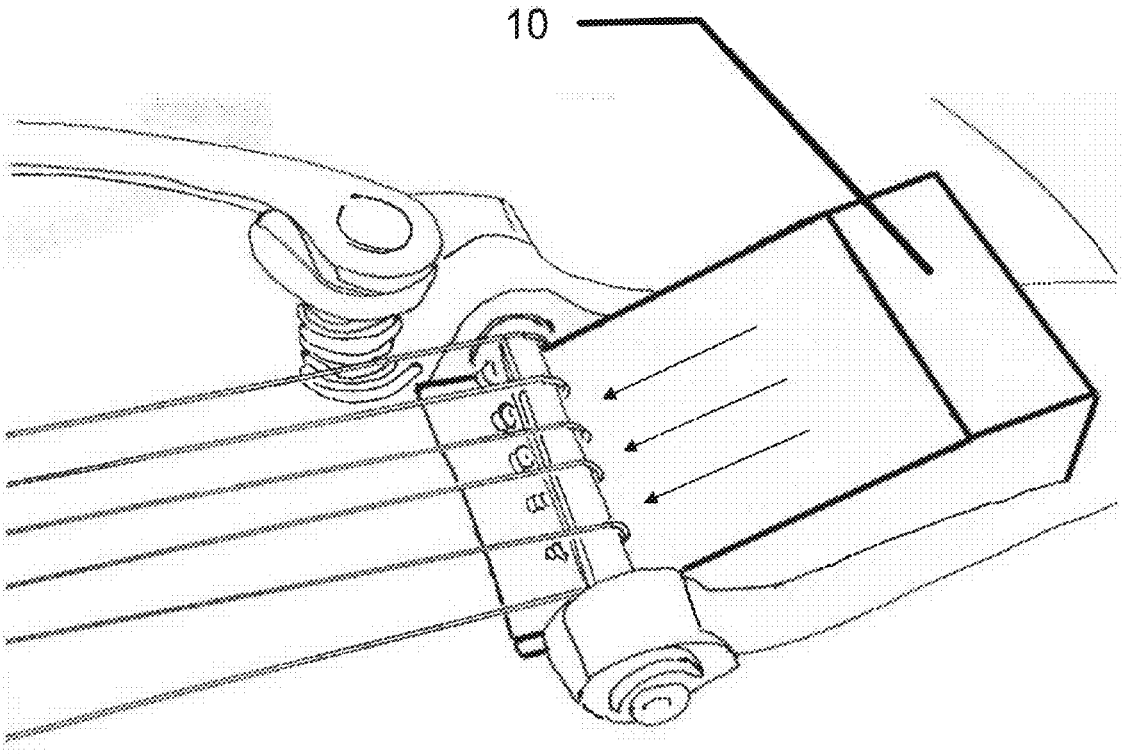
Figure 8:
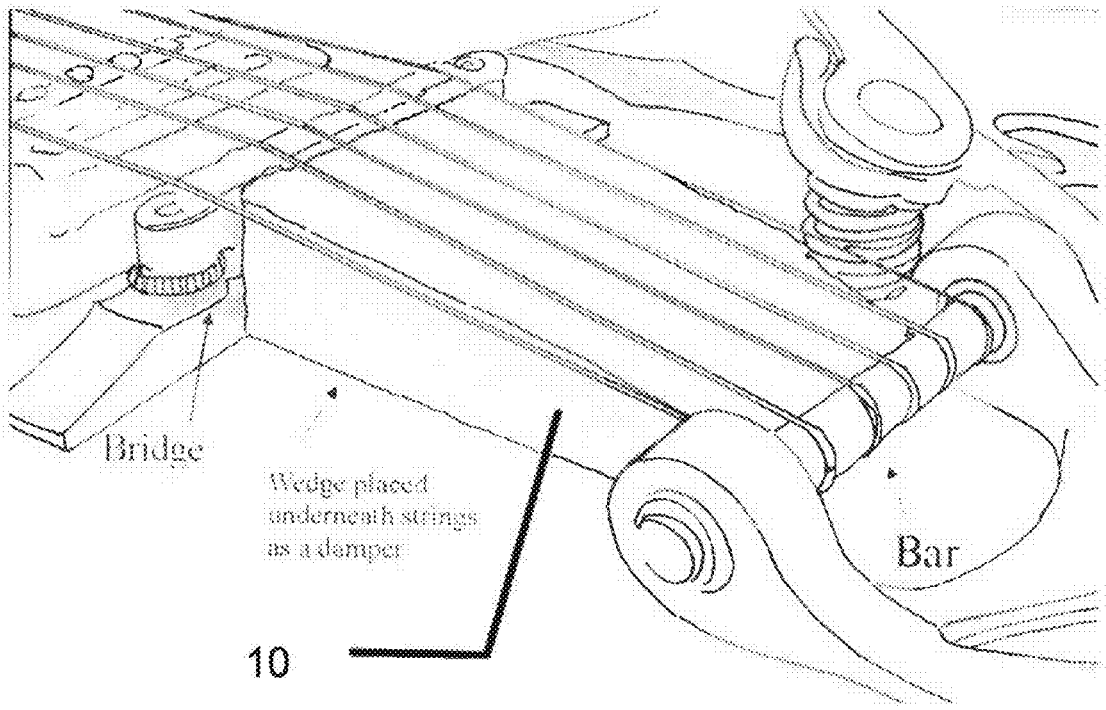

FIGS. 6-8 illustrate an embodiment of the invention whereby a string installer is inserting the device into the space between the Bigsby tailpiece and the front face of a guitar to temporarily hold at least one guitar string eyelet onto a pin of the Bigsby tailpiece so that the installer can then focus on installing the other end of the guitar string the headstock tuning peg and which may also be inserted under the strings between the Bigsby bar and the bridge to act as a damper.

Figure 9:
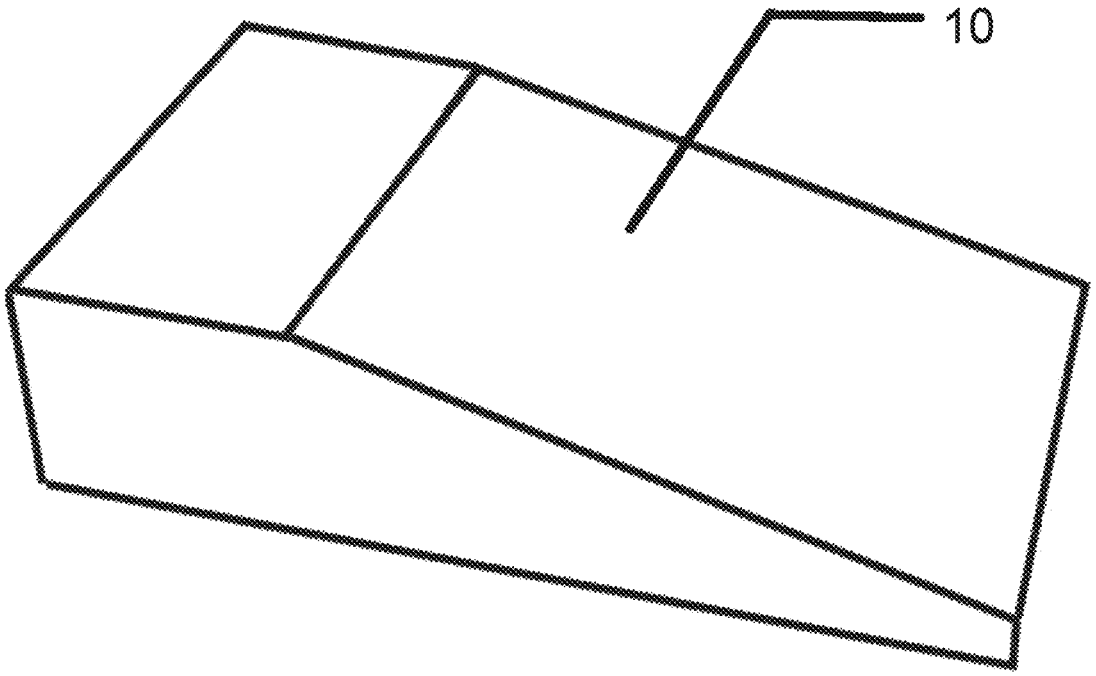
Figure 10:
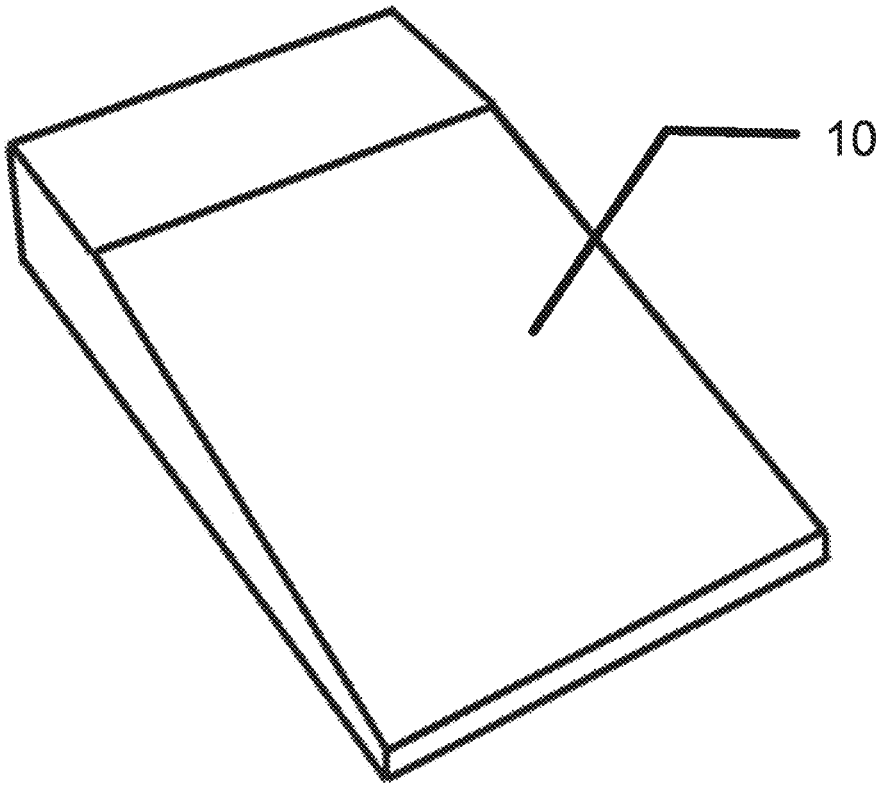
Figure 11:
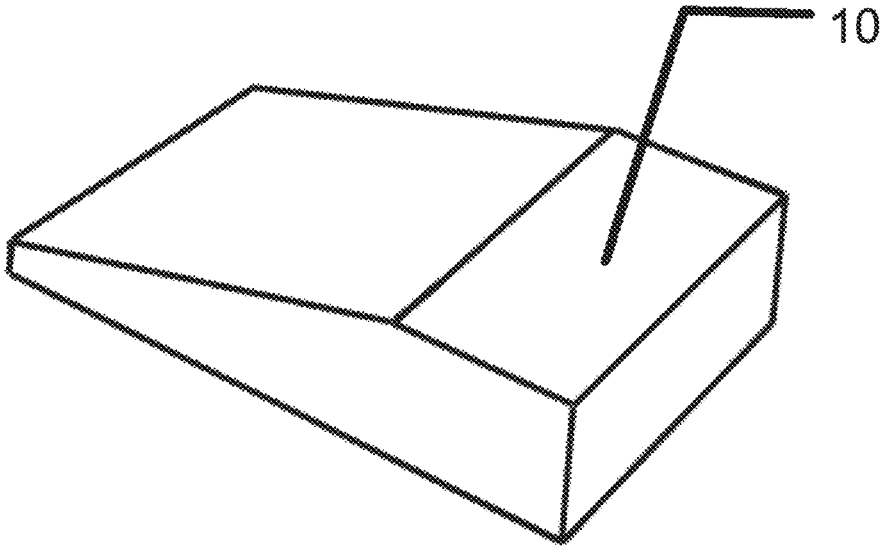

FIGS. 9-11 illustrate other perspective views of an embodiment of the invention.

DESCRIPTION OF THE PREFERRED EMBODIMENTS

Figure 1:
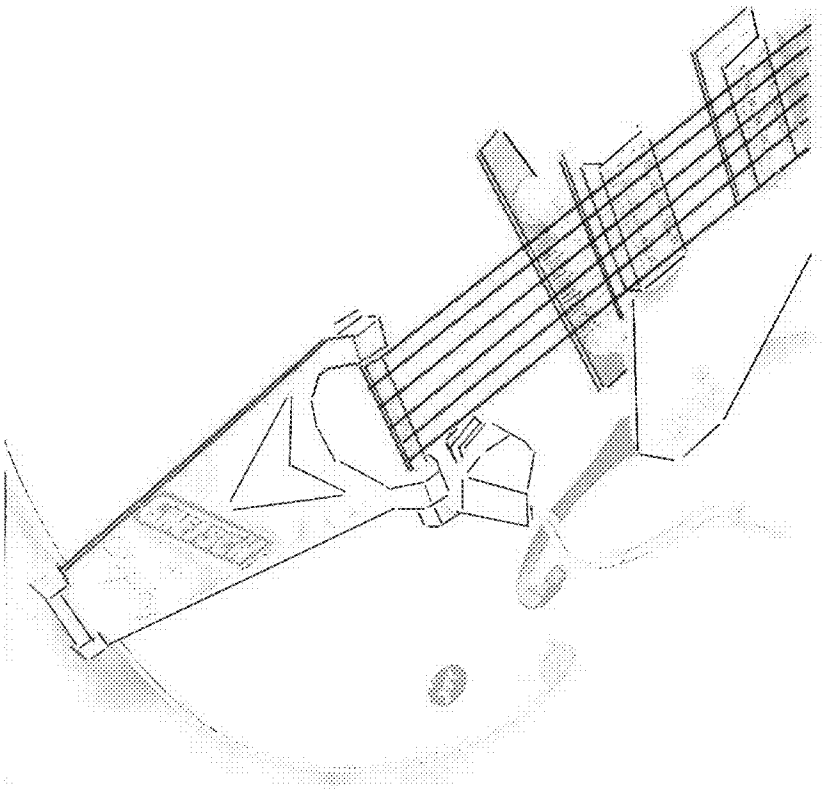
Fig. 1 (prior art)
FIG. 1 illustrates a Bigsby vibrato tailpiece (prior art).
Figure 2:
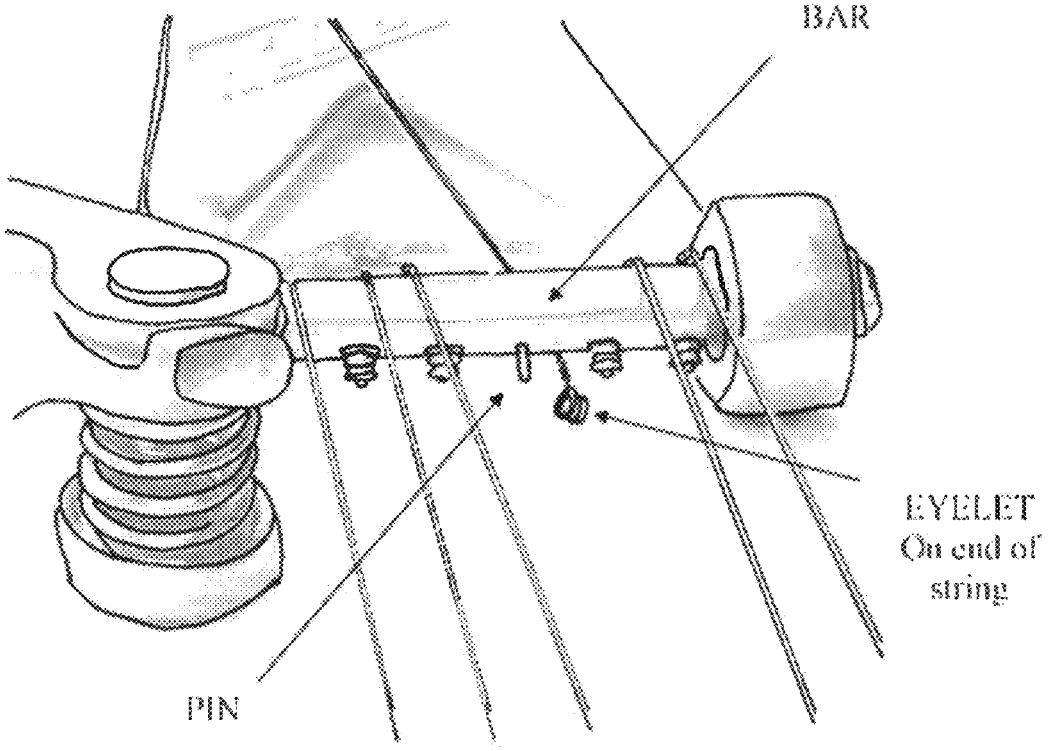
Fig. 2 (prior art)
FIG. 2 illustrates the eyelets of guitar strings placed on the pins of a Bigsby tailpiece and one exposed pin (prior art).
Figure 3:
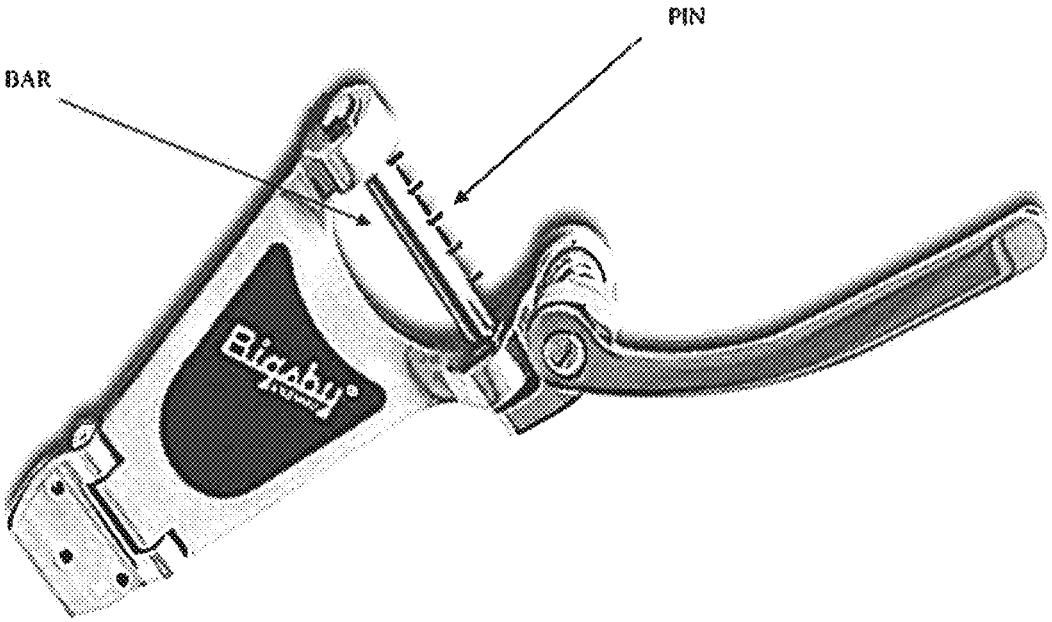
Fig. 3 (prior art)
FIG. 3 illustrates Bigsby vibrato tailpiece (prior art) having a bar and pins.
Figure 4:
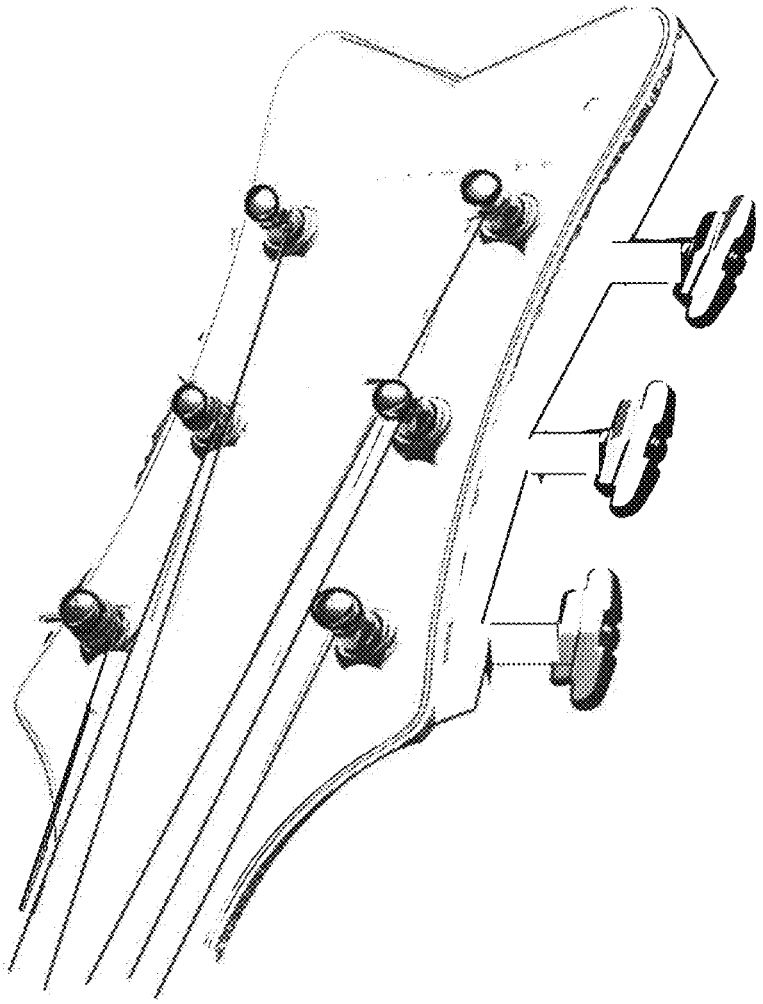
Fig. 4 (prior art)
FIG. 4 illustrates a headstock and tuning pegs (prior art).
Figure 5:
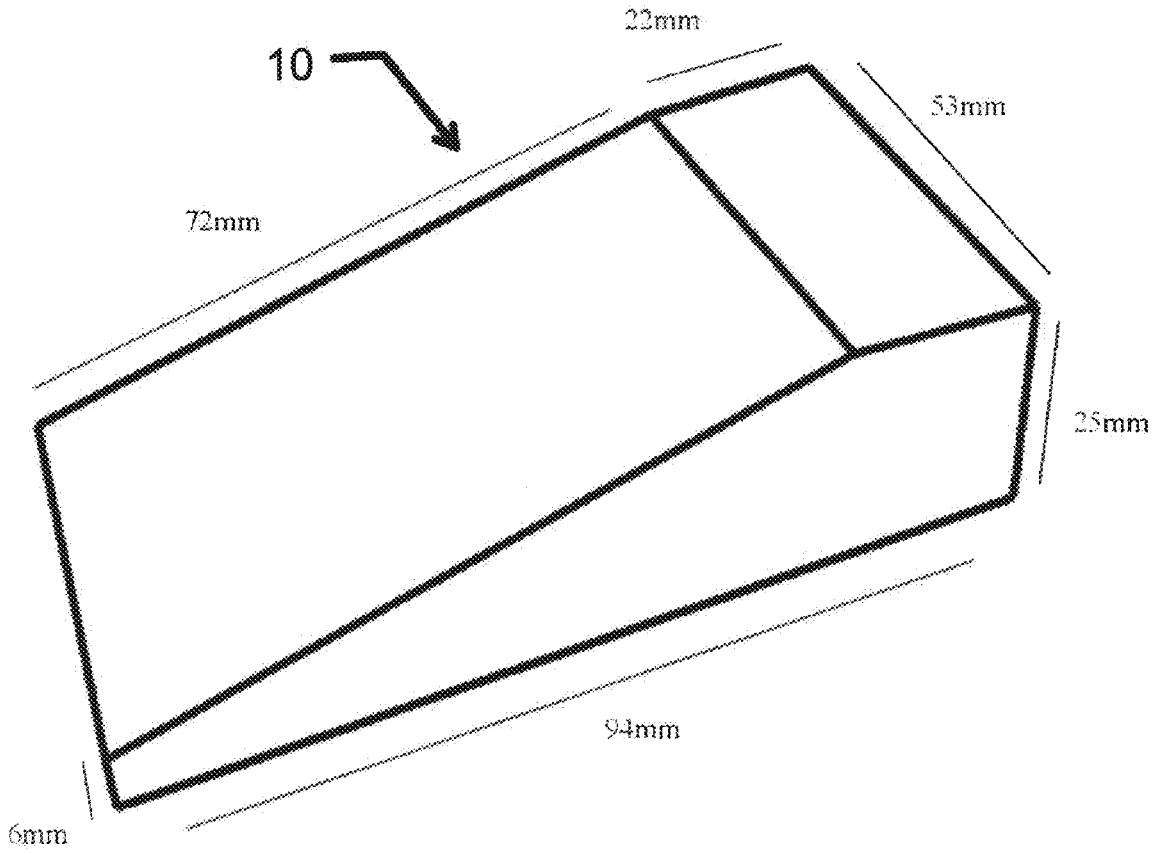
FIG. 5 illustrates a perspective view of an embodiment of the invention.

The string changing device of this invention makes changing the strings on a guitar with a Bigsby Tailpiece easier and quicker. In order for the string changing device to work properly, it is critical to create the device from a springy material having compression, recovery and firmness to be pushed under the bar and stay in place for the duration of the winding of the other end of the string, yet recover its shape on removal so it could be used again and again. Turning now to FIG. 5, it has been found that flexible urethane foam, specifically polyether-base urethane polymer foam having a density between 0.9 to 4 lbs per cubic feet will work suitably well when the dimensions of string changing device 10 are as follows:

53 mm wide,
94 mm long,
6 mm deep at the narrow end
25 mm deep at the wider end and
22 mm rectangular flat surface, also called a platform, before the angle falls away to the narrower end.

For an alternate embodiment, the dimensions of the string changing device 10 may be as follows:

2.16" wide,
3.7" long,
0.31" deep at the narrow end and
0.59" deep at the wider end.

In addition to the above uses of the string changing device 10 of this invention, it has also been found that another embodiment where the user can insert the whole wedge and long ways between the bar of the Bigsby and the Bridge with the wider end nearest to the Bridge. More preferably, the user turns the string changing device 10 over and inserts the whole wedge and long ways between the bar of the Bigsby and the Bridge with the wider end nearest to the Bridge.

The above dimensions and foam characteristics reflect the preferred string changing device 10. Those in the art, of course, will be able to adjust the dimensions and the springiness of the foam so that other suitable device combinations can be made.

While the invention has been described by means of specific embodiments, numerous modifications and variations could be made thereto by those ordinarily skilled in the system development field without departing from the score and spirit of the invention set for the in the claims.

What is claimed is:

1. A string changing device for elevated tailpieces on guitars, the device comprising:

a foam block comprising:

(a) a top rectangular face comprising a width no longer than 58 mm;

(b) a bottom rectangular face comprising a width no longer than 58 mm;

(c) a front rectangular face comprising a width no longer than 58 mm and a height no greater than 8 mm;

(d) a back rectangular face comprising a width no longer than 58 mm and a height at least 19 mm; and (e) a pair of trapezoidal side faces, the foam block configured to slide into a space between the elevated tailpiece and a front face of a guitar to temporarily hold at least one eyelet of a guitar string onto a pin of the elevated tailpiece.

2. A string changing device for elevated tailpieces on guitars, the device comprising:

a foam block comprising:

(a) a top rectangular face comprising a width no greater than 53 mm and a height no greater than 8 mm;

(b) a rectangular flat surface of no greater than 22 mm in depth at the deepest topside end then dropping down to the narrow end;

(c) a bottom rectangular face comprising a width no greater than 53 mm;

(d) a front rectangular face comprising a width no greater than 53 mm;

(e) a back rectangular face comprising a width no greater than 53 mm and a height at least 25 mm; and (f) a pair of side faces, the foam block configured to slide into a space between the elevated tailpiece and a front face of a guitar to temporarily hold at least one eyelet of a guitar string onto a pin of the elevated tailpiece.

3. A method for string changing and dampening of a guitar having an elevated tailpiece, comprising the steps of:

(1) inserting a foam block into a space between the elevated tailpiece and a front face of the guitar to temporarily hold at least one eyelet of a guitar string onto a pin of the elevated tailpiece, the foam block having:

(a) a top rectangular face comprising a width no greater than 53 mm and a height no greater than 8 mm;

(b) a rectangular flat surface of no greater than 22 mm in depth at the deepest topside end then dropping down to the narrow end;

(c) a bottom rectangular face comprising a width no greater than 53 mm;

(d) a front rectangular face comprising a width no greater than 53 mm;

(e) a back rectangular face comprising a width no greater than 53 mm and a height at least 25 mm; and (f) a pair of side faces, and (2) installing a string on a headstock tuning peg with a guitar string installer.

* * * * *